US007628005B2

(12) United States Patent
Schaeffler

(10) Patent No.: US 7,628,005 B2
(45) Date of Patent: Dec. 8, 2009

(54) AIR JET SPINNING MACHINE

(75) Inventor: Gernot Schaeffler, Waeschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 81 days.

(21) Appl. No.: 11/665,928

(22) PCT Filed: Oct. 18, 2005

(86) PCT No.: PCT/EP2005/011193

§ 371 (c)(1),
(2), (4) Date: Nov. 6, 2007

(87) PCT Pub. No.: WO2006/045492

PCT Pub. Date: May 4, 2006

(65) Prior Publication Data

US 2008/0190090 A1 Aug. 14, 2008

(30) Foreign Application Priority Data

Oct. 21, 2004 (DE) ..... 10 2004 052 510

(51) Int. Cl.
*D01H 4/02* (2006.01)

(52) U.S. Cl. ..... 57/350; 57/264; 57/403

(58) Field of Classification Search ..... 57/264, 57/350

See application file for complete search history.

(56) References Cited

U.S. PATENT DOCUMENTS

| | | | | | |
|---|---|---|---|---|---|
| 3,926,665 | A | * | 12/1975 | Harrap et al. | 134/18 |
| 4,202,163 | A | * | 5/1980 | Turk et al. | 57/401 |
| 4,988,049 | A | | 1/1991 | Konishi | |
| 5,048,281 | A | | 9/1991 | Dallmann et al. | |
| 5,050,816 | A | * | 9/1991 | Niederer | 242/149 |
| 5,839,265 | A | * | 11/1998 | Takagi et al. | 57/290 |
| 6,134,872 | A | * | 10/2000 | Olbrich | 57/264 |

FOREIGN PATENT DOCUMENTS

| | | |
|---|---|---|
| DE | 38 23 289 A1 | 1/1989 |
| DE | 38 36 481 A1 | 5/1990 |
| DE | 44 46 379 A1 | 6/1996 |
| DE | 100 41 363 A1 | 3/2002 |
| EP | 0 365 931 B1 | 5/1990 |
| GB | 1135088 | 11/1968 |

OTHER PUBLICATIONS

International Search Report dated Mar. 30, 2006 with English translation of relevant portion (Six (6) pages).

* cited by examiner

*Primary Examiner*—Shaun R Hurley
(74) *Attorney, Agent, or Firm*—Crowell & Moring LLP

(57) ABSTRACT

An air jet spinning machine for producing spun threads from staple fiber strands includes a number of spinning positions, to each of which compressed air nozzles are arranged for the purpose of generating the spinning twist. A joint compressed air regulator is connected upstream of the spinning positions, which regulator includes a pressure sensor and a regulating device. The compressed air regulator is set at a reference pressure, which corresponds to the unregulated static pressure prevailing when all spinning positions are in operation. In the case of a change in the static pressure, the compressed air regulator re-adjusts to the reference pressure.

6 Claims, 1 Drawing Sheet

$p_S$
$p_0$
$p_U$
$p_R$
10
20
30
40
170
180
190
200
z

B
3
8
1
2
7
9
10
11
14
13
12
6
A
5
4

AIR JET SPINNING MACHINE

BACKGROUND AND SUMMARY OF THE INVENTION

The present invention relates to an air jet spinning machine for producing spun threads from staple fiber strands, having a number of spinning positions, to each of which compressed air nozzles are arranged for the purpose of generating the spinning twist. The machine includes a joint compressed air regulator connected upstream of the spinning positions, the regulator including a pressure sensor and a regulating device for adjusting the measured static pressure.

An air jet spinning machine is known from German published patent application DE 38 36 481 C2, which discloses a compressed air regulator that reacts to changes in the constantly monitored spinning tension. In one variation, an attempt is made to keep the spinning tension constant in that the pressure acting on the compressed air nozzles is correspondingly adjusted. For this purpose, a pressure sensor is arranged to the compressed air regulator, which transfers the measured data to a control system for analysis. The control system includes a regulating device for changing the respective pressure.

In the case of the air jet spinning machines according to the present invention, the problem is somewhat different, as it is not provided that the pressure on hand at the compressed air nozzles is adjusted at any one time to the monitored spinning twist. Rather, a solution is sought in which the static pressure acting on the compressed air inlet of a longer air jet spinning machine is independent of how many spinning positions are operational at any one time. The operational pressure of the spinning mill, namely that which is considered to be constant, prevails at the compressed air inlet of an air jet spinning machine and measures as a rule 6 bar. If, however, all spinning positions are in operation, the static pressure can fall below 5 bar. If only a number of the spinning positions are in operation, the drop in static pressure is correspondingly lower. The latter is, for example, the case when the air jet spinning machine is starting up, or when several spinning positions are temporarily not in operation due to an end break.

It is an object of the present invention to permanently maintain a constant level of static pressure independently of how many spinning positions of an air jet spinning machine are in operation.

This object has been achieved in accordance with the present invention in that the compressed air regulator is set at a reference pressure, which corresponds to the unregulated static pressure prevailing when all the spinning positions are in operation, and in that the compressed air regulator re-adjusts to the reference pressure when a change in the static pressure occurs.

According to the invention, the compressed air regulator, which includes a compressed air sensor and a regulating device, is designed as a true actuator, by which the static pressure at the compressed air inlet of the air jet spinning machine is kept constant. If, for example, a number of spinning positions fail, resulting in an increase in the static pressure, the compressed air regulator adjusts the static pressure back down to the level of the reference pressure. When the stopped spinning positions are subsequently put into operation again, the downwardly adjusted pressure drops again, but is adjusted upwards again to the level of the reference pressure by the compressed air regulator.

The reference pressure cannot, of course, be greater than the lowest unregulated level of static pressure occurring when all the spinning positions of an air jet spinning machine are in operation. It is, however, by all means possible to choose the reference pressure at a lower level than that of the above mentioned static pressure.

In one embodiment of the present invention, it is provided that the chosen reference pressure is lower than the unregulated static pressure when all spinning positions are in operation. A lower level reference pressure is by all means possible within certain limits and has the advantage in that the static pressure can always be adjusted upwards and also downwards. This "pressure play" permits, for example, not only the static pressure to be kept constant, but also permits variations in the yarn twist within certain limits at a pre-determined draw-off speed of the spun thread.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 2:
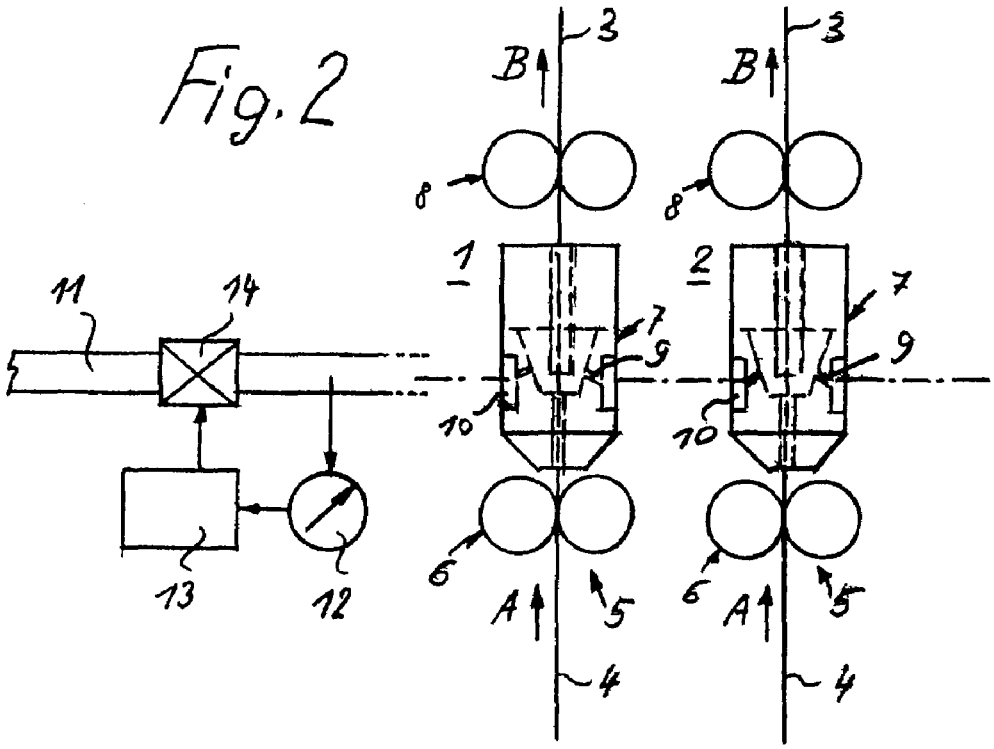
FIG. 2 shows in a very schematic representation the provided joint compressed air regulator for a number of spinning positions.

An air jet spinning machine has a number of spinning positions, of which only two spinning positions 1 and 2 are schematically shown in FIG. 2. Each spinning position 1, 2 serves to produce a spun thread 3 from a staple fiber strand 4.

A spinning position 1, 2 includes as essential components a drafting device 5, of which only one delivery roller pair 6 bordering the drafting zone is shown, and also an air jet aggregate 7, a draw-off roller pair 8, and a winding device (not shown).

The staple fiber stand 4 fed in feed direction A is drafted in the respective drafting device 5 to the desired degree of fineness. The thread 3 drawn off in draw-off direction B receives in the respective air jet aggregate 7 its spinning twist. A number of compressed air nozzles 9 are arranged for this purpose in the individual air jet aggregates 7, as is known in many cases from prior art, so that the spinning process itself need not be described in any greater detail. The individual compressed air nozzles 9 extend out advantageously from an annular space 10, whereby the annular spaces 10 of all air jet aggregates 7 are connected to a joint compressed air conduit 11 located upstream. This compressed air conduit 11 receives the operational pressure installed in the respective spinning mill of, for example, 6 bar and can be seen as a type of accumulator for the air jet spinning machine.

The static pressure prevailing at the compressed air inlet of the air jet spinning machine is now dependent on the number of spinning positions 1, 2 . . . of the air jet spinning machine currently in operation. If only a few spinning positions 1, 2 . . . are in operation, then the static pressure present in the compressed air conduit can be approximately equated with the operational pressure installed in the spinning mill. If, however, all available spinning positions 1, 2 . . . of the air jet spinning machine are in operation, then the static pressure at the compressed air inlet of the air jet spinning machine drops significantly, in certain circumstances by more than 1 bar. It is evident that as a result, the intensity of the spinning twist of the individual threads 3, and therefore the quality of the thread, varies. The present invention seeks to avoid this situation.

Figure 1:
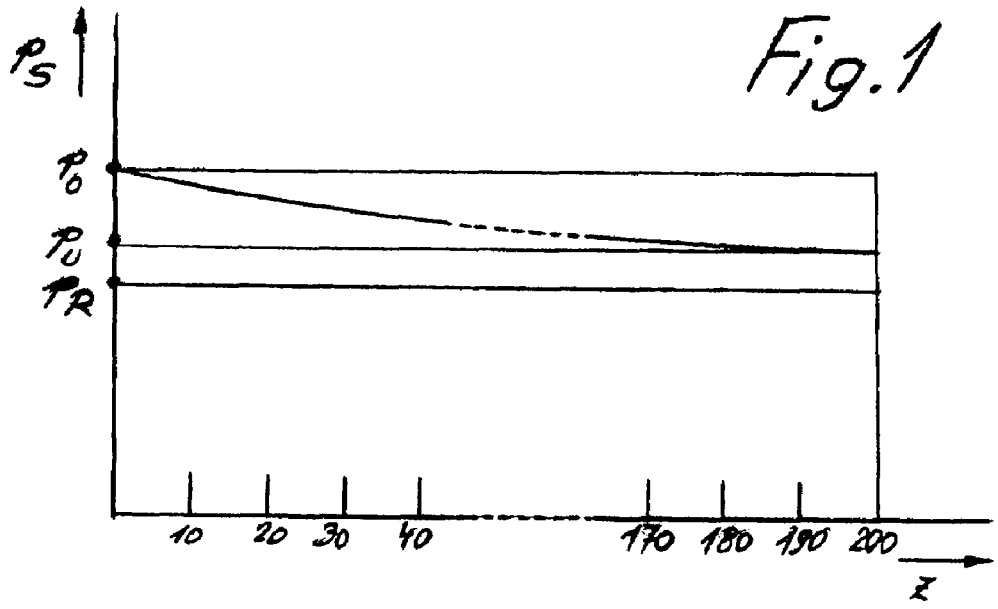
FIG. 1 is a diagram demonstrating the dependence of the static pressure prevailing at the compressed air inlet of the air jet spinning machine from the number of the spinning positions in, operation.

The above-mentioned problem is shown in FIG. 1 in the form of a diagram, in which the abscissa lists the number z of spinning positions 1, 2 . . . in operation at a given time, while the ordinate lists the respective prevailing static pressure $p_s$.

It can be seen with the aid of FIG. 1 that when none of the spinning positions 1, 2 . . . is in operation, a static pressure $p_o$ prevails at the compressed air inlet of the air jet spinning machine. When, however, all spinning positions 1, 2 . . . , in this case for example 200 positions, are in operation, the static pressure drops to a value of $p_u$. Depending on the number of spinning positions 1, 2 . . . in operation, a static pressure prevails which lies between the uppermost pressure $p_o$ and the lowest pressure $p_u$.

In order to avoid this, measures are taken in accordance with the present invention so that the prevailing static pressure $p_s$ remains constant during all operational states of the air jet spinning machine.

For a number of spinning positions 1, 2 . . . , either for all spinning positions 1, 2 . . . of an air jet spinning machine or for only a pre-determined number of spinning positions 1, 2 . . . of a machine section, a joint compressed air regulator, connected upstream, is provided, which keeps the static pressure $p_s$ constant. For this purpose, the compressed air regulator is set at a so-called reference pressure $p_R$. As shown clearly in FIG. 1, this reference pressure $p_R$ must not be greater than the static pressure $p_u$ described above. The reference pressure $p_R$ can, however, be somewhat less than the pressure $p_u$. In any case, the reference pressure $p_R$ corresponds to that unregulated static pressure $p_u$ when all spinning positions 1, 2 . . . are in operation.

The compressed air regulator includes a pressure sensor 12, for measuring the overall prevailing static pressure at the compressed air inlet of the air jet spinning machine or machine section, and a regulating device 13. The latter acts on a choke valve 14 of the compressed air conduit 11. The compressed air regulator can, therefore, constantly re-adjust to the reference $p_R$ in the case of a change in the static pressure $p_s$ in the manner described above. If, for example, a number of spinning positions 1, 2 fail, the static pressure $p_s$ measured by the pressure sensor 12 increases. In this case, the reference pressure $p_R$ is immediately re-adjusted via the regulating device 13 and the choke valve 14. In the reverse case, when previously stopped spinning positions 1, 2 . . . are again in operation, the downwardly adjusted pressure drops again, but is re-adjusted upwards again to the reference pressure $p_R$.

The reference pressure $p_R$ can, if required, be equal to the static pressure $p_u$. If the reference pressure $p_R$ is set at a somewhat lower level, than a certain tolerance for the regulation process exists, which tolerances range not only upwards but also downwards. This can be used to advantage in that the spinning twist imparted to the thread 3 can be varied within certain limits.

For the sake of clarity it is mentioned at this point that when the air jet spinning machine is at a complete standstill, the regulation process is shut down and the compressed air is shut off.

The invention claimed is:

1. Air jet spinning machine in a spinning mill having a source of compressed air for producing spun threads from staple fiber strands, comprising:

a plurality of spinning positions each equipped with an air jet aggregate for imparting a spinning twist to a fiber strand;

a compressed air inlet of the spinning machine to which the air jet aggregates of the spinning positions are commonly connected, the compressed air inlet being coupled to the source of compressed air of the spinning mill;

a compressed air regulator for adjusting to a set value a static pressure of the compressed air passing through the compressed air inlet upstream of the common connection with the air jet aggregates;

wherein the set value is a reference pressure which is equal to or less than an unregulated static pressure prevailing at the compressed air inlet when all spinning positions are in operation, and further wherein the compressed air regulator re-adjusts to the set value in the case of a change in the static pressure.

2. The air jet spinning machine according to claim 1, wherein a chosen reference pressure is less than that of the unregulated static pressure when all the spinning positions are in operation.

3. An air jet spinning machine for producing spun threads from staple fiber strands, comprising:

a plurality of spinning positions, each spinning position being equipped with an air jet aggregate for imparting spinning twist to a fiber strand, the air jet aggregates of the spinning positions being connected to a common connection for a source of compressed air of a spinning mill; and wherein downstream from the common connection for the source of compressed air a regulator is arranged for adjusting to a set value a static pressure of compressed air passing through the common connection.

4. The air jet spinning machine according to claim 3, wherein the set value is a value less than an unregulated static pressure of the air passing the common connection when all of the plurality of spinning positions are in operation.

5. A method of operating an air jet spinning machine for producing spun threads from staple fiber strands, the spinning machine including a plurality of spinning positions each equipped with an air jet aggregate for imparting spinning twist to a fiber strand, the air jet aggregates of the spinning positions being commonly connected to a compressed air inlet of the spinning machine through which compressed air from a source of the spinning mill passes, the method comprising the acts of:

selecting a reference static pressure for the compressed air passing through the compressed air inlet from the source;

regulating the static pressure of the compressed air passing through the compressed air inlet to maintain the selected reference static pressure in an event of a change in the static pressure; and wherein the selected reference static pressure is selected to be equal to or less than a prevailing unregulated static pressure when all spinning positions of the spinning machine are operational.

6. The method according to claim 5, wherein the selected reference static pressure is less than the prevailing unregulated static pressure available when all spinning positions of the spinning machine are operational.

* * * * *